United States Patent [19]

Murphy

[11] Patent Number: 4,516,193

[45] Date of Patent: May 7, 1985

[54] LIGHTING SYSTEM FOR ARTIFICIAL CHRISTMAS TREE

[76] Inventor: James P. Murphy, 211 Executive Office Park, 4500 W. Illinois Ave., Midland, Tex. 79703

[21] Appl. No.: 600,947

[22] Filed: Apr. 16, 1984

[51] Int. Cl.[3] ..... F21P 1/02

[52] U.S. Cl. ..... 362/123; 362/252; 362/806; 339/59 L; 339/61 L; 339/119 L

[58] Field of Search ..... 362/123, 249, 252, 806; 339/59 L, 59 M, 61 L, 61 M, 119 L

[56] References Cited

U.S. PATENT DOCUMENTS

| | | | |
|---|---|---|---|
| 2,453,695 | 11/1948 | Belling | 362/806 X |
| 2,453,925 | 11/1948 | Mendonca | 362/806 X |
| 2,533,722 | 12/1950 | Cohen | 362/249 |
| 2,558,029 | 6/1951 | Wood | 339/119 L X |
| 2,759,095 | 8/1956 | Kline | 362/123 X |
| 2,857,506 | 10/1958 | Minteer | 362/123 X |
| 3,527,933 | 9/1970 | Thümmel | 339/59 L X |
| 3,752,407 | 8/1973 | Baugh et al. | 362/806 X |
| 4,072,857 | 2/1978 | De Vicaris | 362/252 X |
| 4,112,482 | 9/1978 | Powell | 362/191 X |

FOREIGN PATENT DOCUMENTS 2529258 10/1976 Fed. Rep. of Germany ..... 362/123

*Primary Examiner*—Peter A. Nelson

*Attorney, Agent, or Firm*—H. Mathews Garland

[57] ABSTRACT

An electrical lighting system for a tree especially adapted to an artificial Christmas tree having removable limbs. The system includes electrical conducting distribution straps or bands which may be wrapped around and secured to a tree trunk at selected levels. Each of the distribution bands has prong means and electric lead and plug means for interconnecting the bands along the tree trunk and a plurality of spaced apertures for insertion of male electrical plugs around each of the bands on the tree trunk. Also included are electrical branch circuits having a plurality of sockets and bulbs for mounting on each of the removable tree limbs, each of the circuits having a male plug connectible with the spaced apertures on the nearest distribution band for supplying electricity from the band to the branch circuit. After the bands and the branch circuits are installed on the tree trunk and removable tree limbs, the bands and branch circuits may remain on the trunk and limbs when the trunk and limbs are disassembled for storage purposes.

6 Claims, 6 Drawing Figures

LIGHTING SYSTEM FOR ARTIFICIAL CHRISTMAS TREE

This invention relates to lighting systems and more particularly relates to a lighting system for an artificial Christmas tree.

Artificial Christmas trees have become a major factor in the Christmas tree decoration industry. A variety of tree designs are available. Some of the trees comprise a permanent tree trunk and limb assembly with the limbs secured along the trunk at fixed positions. Other forms of such artificial trees have a folding limb arrangement whereby the limbs remain secured to the tree trunk but fold upwardly and inwardly along the trunk for storage purposes. Also, artificial tree lighting systems are available which comprise a removable strip secured along the tree trunk with a plurality of female electrical connections into each of which is plugged an individual light which may be arranged along a limb of the tree. These various forms of available artificial trees with lights and lighting systems useful with artificial trees are disclosed in the following U.S. patents: U.S. Pat. No. 2,857,506, issued Oct. 21, 1958 to Minteer; U.S. Pat. No. 3,214,579 issued Oct. 26, 1984 to Pacini; U.S. Pat. No. 3,603,780 issued Sept. 7, 1971 to Lu; U.S. Pat. No. 3,970,834 issued July 20, 1976 to Smith; U.S. Pat. No. 4,020,201 issued April 26, 1977 to Miller; U.S. Pat. No. 4,156,892 issued May 29, 1979 to Fisher; U.S. Pat. No. 4,161,768 issued July 17, 1979 to Gauthier et al.

U.S. Pat. No. 3,214,579 shows a Christmas tree lighting system which is adaptable to a tree having removable limbs in the sense that the female conducting strip may be strapped along the tree trunk with each of the branch circuits being connectible into the strip and arranged on a tree limb. The female connection member or distribution strip in this patented system is manufactured substantially the length of the tree trunk. Thus with the wide variety of tree trunk lengths which are manufactured and sold, this particular patented system would require a different distribution strip for each of the tree trunk lengths which presents a substantially increased manufacturing and stocking cost.

It is a principal object of the invention to provide a new and improved artificial Christmas tree lighting system.

It is another object of the invention to provide an artificial Christmas tree lighting system which is especially adapted to use with trees having removable limbs.

It is another object of the invention to provide an artificial Christmas tree lighting system which is readily adapted to a variety of tree sizes including different tree trunk lengths and different numbers of limbs.

It is another object of the invention to provide an artificial Christmas tree lighting system which minimizes manufacturing and stocking expenses.

It is another object of the invention to provide an artificial Christmas tree system wherein a variable number of tree trunk distribution straps are arranged along the length of a tree trunk and individual separate limb circuits are plugged into the distribution strips and arranged along the individual limbs.

It is another object of the invention to provide an artificial Christmas tree lighting system wherein the individual limb circuits may be left on the limbs after the limbs are removed from the tree trunk for more efficient storage of both the limbs and the limb lighting circuits.

In accordance with the invention there is provided a lighting system for artificial Christmas trees having removable limbs which includes electrical distribution straps connectible around the tree trunk, extension cord connections between the straps arrangeable along the tree trunk, and removable individual limb lighting circuits connectible into the distribution straps and arrangeable on the individual removable tree limbs. The separate limb lighting circuits may be each arranged on and secured to each of the removable limbs of the tree remaining on the limbs when the limbs are separated from the trunk for storage purposes.

The foregoing objects and advantages will be better understood from the following detailed description of a preferred embodiment of the invention taken in conjunction with the accompanying drawings wherein.

Figure 1:
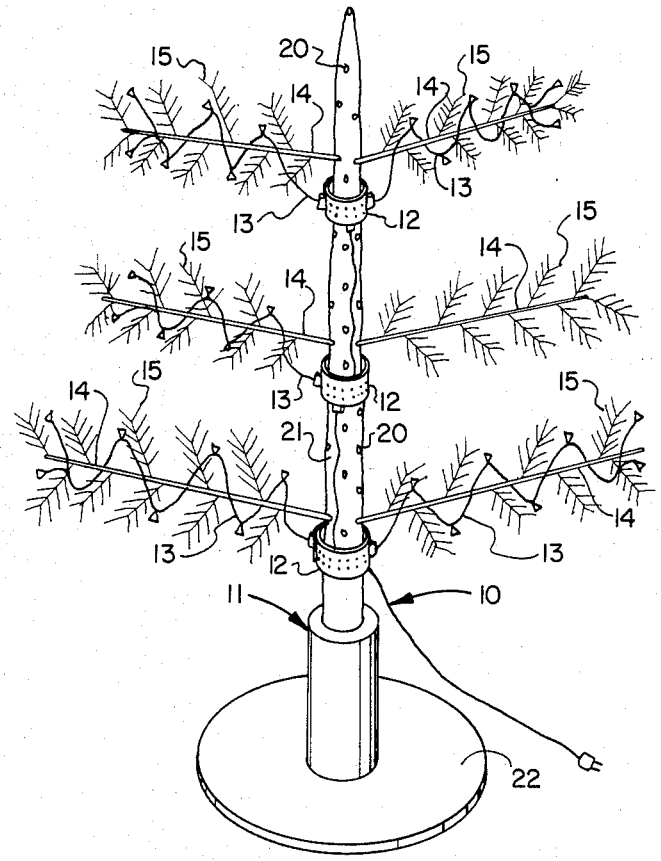
FIG. 1 is a perspective view of a lighting system embodying the features of the invention installed on an artificial Christmas tree having removable limbs.

Referring to FIG. 1, a tree lighting system 10 embodying the features of the invention is installed on an artificial Christmas tree 11. The lighting system 10 includes a plurality of electrical distribution bands or straps 12 to each of which is connected a plurality of branch light circuits 13 each of which is supported on a tree limb 14 having branches 15. The limbs 14 are removably inserted along inward end portions into holes 20 formed along the trunk 21 of the tree. The trunk is mounted in a base 22. In accordance with the invention each of the branch lighting circuits 13 is wound about a limb 14 with its branches 15 so that the branch circuit may remain on the limb when the limb is removed from the tree trunk for storage purposes. Thus once the lighting system 10 is installed on the artificial tree 11 the branch lighting circuits 13 remain with the limbs 14 while the distribution bands 12 remain on the tree trunk 21 while the tree is assembled in use and when the tree is disassembled and in storage.

Figure 2:
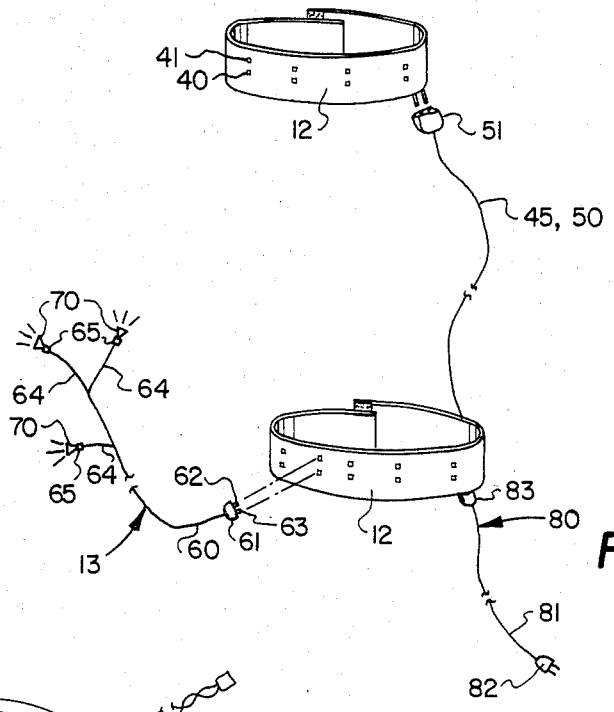
FIG. 2 is an exploded view in perspective showing two electrical distribution bands and one branch circuit embodying the features of the invention.
Figure 4:
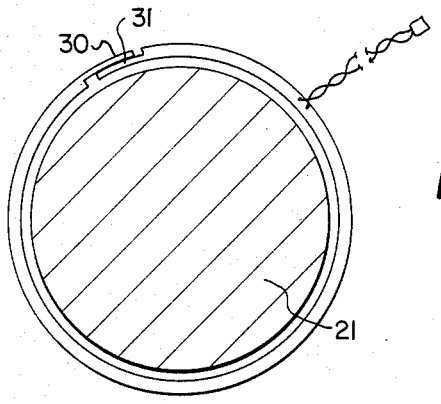
FIG. 4 is a view in section and elevation showing the distribution band of FIGS. 2 and 3 strapped around a tree trunk.
Figure 3:
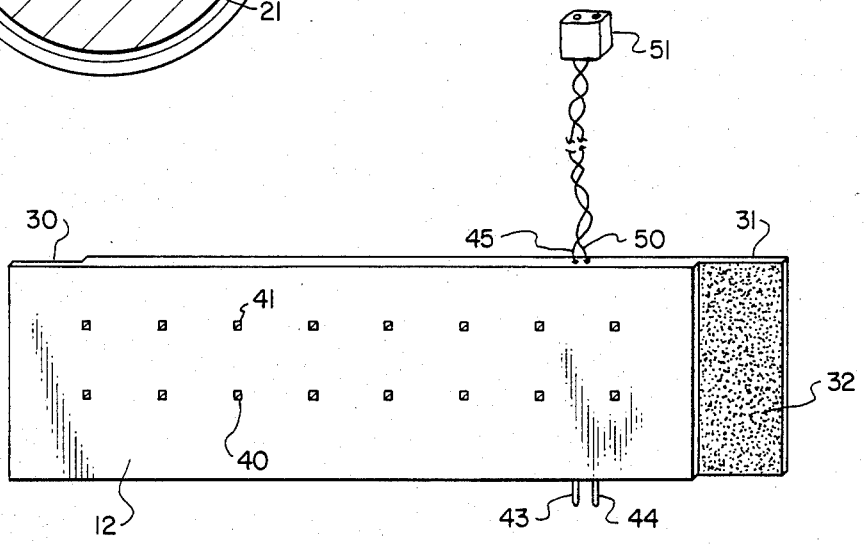
FIG. 3 is an enlarged view in perspective showing one of the distribution bands of the invention.
Figure 5:
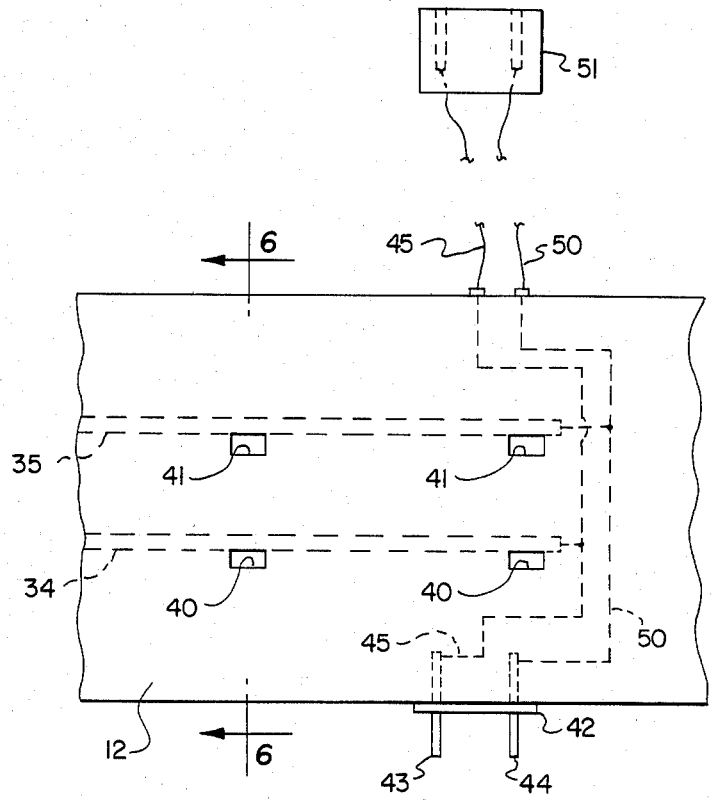
FIG. 5 is a further enlarged fragmentary view in elevation showing in phantom lines the electrical circuits of the distribution band of FIG. 3.
Figure 6:
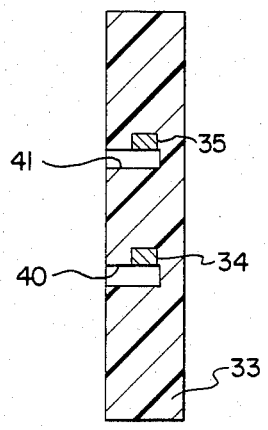
FIG. 6 is a view in section along the line 6—6 of FIG. 5.

Referring to FIGS. 2–4, each of the electrical distribution bands 12 is a flat, flexible member sufficiently longer than the diameter of the tree trunk 21 for the bands to each fully encircle the tree trunk with overlapping opposite ends for securing the bands on the trunk. Each of the bands 12 has reduced thickness opposite end portions 30 and 31 each of which is faced with an adhesive-like material 32 sold under the trademark Velcro. When two surfaces faced with Velcro are placed together a strong removable connection is made. The distribution bands are each installed on the trunk by wrapping the band around the trunk as shown in FIG. 4 with the opposite end portions 30 and 31 being placed together so that the Velcro surfaces adhere to secure the ends in a tight relationship to hold the band on the tree trunk. Each of the end portions 30 and 31 is approximately one-half the thickness of the strap 12 so that at the connection along the ends the assembled strap is approximately the same thickness as the remaining portion of the strap around the tree trunk. This provides a smooth joint between the end portions of the strap when wrapped around the tree trunk. Referring also to FIGS. 5 and 6, the strap 12 is a molded electrical insulating material formed of a suitable rubber or plastic. During the molding process a pair of electrical conductors 34 and 35 are embedded in longitudinal parallel spaced relation within the strap for conducting electricity to the branch electrical circuits 13. Pairs of spaced apertures 40 and 41 are molded in the strap 12 along the length of the strap. One side of the apertures 40 and 41 extends along a side of the adjacent conductors 34 and 35, respectively, so that plug prongs when introduced into the apertures may make electrical contact with the conductors 34 and 35. An electrical plug 42 having prongs 43 and 44 is molded into a lower edge of the strap 12. An electrical lead 45 is connected with the prong 43 and a portion of the lead is molded in the strap extending across the strap and connected with an end of the conductor 34. Similarly the plug prong 44 is connected with an electrical lead 50 molded end and extending across 12 in spaced relation from the lead 45. The lead 50 is connected with an end of the conductor 35. The leads 45 and 50 extend from the upper edge of the strap 12 to a female plug 51 which is connectible to the male plug 42 in the next distribution strap up the tree trunk. The length of the leads 45 and 50 is primarily determined by the desired distance between the straps 12 when mounted on the tree trunk. Referring to FIG. 2 each of the branch electrical circuits 13 includes a lead 60 connected at one end with a plug 61 having prongs 62 and 63 which are spaced and sized to fit the apertures 40 and 41 along the strap 12. A plurality of branch leads 64 are connected in spaced relation along the lead 60 each provided with a light socket 65 and a light 70. The length of each lead 60 as well as the number and placement of the branch leads 64 is determined by the size and design of the tree limbs 14 and branches 15. The number of branch circuits 13 provided will of course depend upon the number of the tree limbs mounted on the tree trunk. As also shown in FIG. 2 a connecting lead or extension cord 80 is provided for connecting the lighting system to a nearby electrical convenience outlet. The extension cord 80 includes an electrical lead 81 connected into a male plug 82 at one end and a female plug 83 at the opposite end. The female plug 83 is designed to fit the male plug 42 in the lower edge of the strap 12.

The various electrical leads, conductors, and plugs forming the apparatus of the invention including the distribution bands 12, the branch circuits 13, and the extension cord 80 are formed of suitable flexible electrical conductors and insulation materials well known to those skilled in the art. The light socket 65 and the light 70 are selected from various available sizes and designs. The particular bulbs and sockets may range from the very small miniature sizes available to large outdoor all weather designs.

The electrical lighting system 10 of the invention is installed initially on an artificial Christmas tree 11 by positioning a plurality of the electrical distribution straps or bands 12 in spaced relation along the tree trunk 21. Each of the straps 12 is wrapped about the trunk at the desired height on the trunk with the Velcro faces 32 on the strap ends 30 and 31 being placed together to secure the ends of the strap together holding the strap around the tree trunk. The length of the straps relative to the diameters along the tree trunk are sized to permit the straps to be pulled sufficiently snug that they will not slip down on the trunk though after all of the tree limbs are installed the straps will not easily move along the trunk. The straps 12 are electrically interconnected by plugging the male prongs on the lower edge of each strap 12 into the female plug 51 on the upper ends of the leads 45 and 50 from the immediate strap 12 next down the trunk until all of the straps 12 are electrically interconnected along the length of the trunk. The lowermost strap 12 is connected with the extension cord 80 by inserting the prongs 43 and 44 on the lowermost strap into the female plug 83 on the extension cord. The male plug 82 is preferably not connected into a nearby convenience outlet until the connections on the tree limbs are made. The branch circuits 13 are then each wrapped about a limb 14 and its branches 15 with the lights 70 being located in desired positions on the branches and the male plug 61 located near the inward end of the limb. The limb is then inserted into one of the holes 20 in the tree trunk and the prongs 62 and 63 on the plug 61 inserted into the nearest aperture 40 and 41 on the nearest distribution band 12. After all of the limbs and electrical circuits on the limbs have been so installed, the tree may then be provided with electrical energy by inserting the male plug 82 into the nearest convenience outlet.

When disassembly and storage of the artificial Christmas tree is desired, the tree is first disconnected from the electrical power by removing the male plug 82 from the convenience outlet. The male plugs 61 are then each removed from the distribution strap 12 into which they are connected. Leaving the electrical circuits 13 on the limbs 14, the limbs 14 are each then removed from the tree trunk 21. The distribution straps 12 are left on the tree trunk and interconnected by the leads 45 and 50 and the plugs 51. The tree trunk is then removed from the base 22 and the limbs, tree trunk and the base are stored. Of course if the tree trunk is made in sections the various sections of the trunk are disconnected from each other and the straps 12 on the separated sections are disconnected by removing the plugs 51 from the prongs 43 and 44 on the adjacent sections which are separated. Thus the entire tree may be disassembled and stored without the need of removing the electrical system of the invention from the various members of the tree.

It will be recognized that the electrical lighting system of the invention is extremely flexible. The components of the system comprising the distribution straps 12 and the limb circuits 13 with the extension cord 80 may be sold as open stock items permitting the purchaser to buy as few or as many as desired depending upon the size and design of the particular artificial tree on which the system is to be used. To accommodate the branch circuits 13 to the various limb lengths found in a tree, the circuits may be made in several different lengths and the circuits may be wrapped either tightly or loosely about the limbs and branches thereby utilizing any single length of circuit on a variety of limb lengths. The distribution straps 12 may be made in several lengths designed for a variety of tree trunk diameters or preferably may have sufficient tolerance due to the lengths of the Velcro covered end portions 30 and 31 to provide substantial adjustment in the strap to accommodate the strap to a variety of tree trunk sizes. Thus the lighting system of the invention may be readily adapted to all of the available sizes of artificial Christmas trees and once purchased and installed on the tree may remain with the tree both when it is assembled and when disassembled so long as the tree is used. The various components of the system may be assembled and packaged and sold with artificial trees or may be made available either in sets or open stock for buyers to use with trees they already have.

What is claimed is:

1. An electrical lighting system for a tree comprising: flexible electrical distribution strap means having opposite end means for mounting said strap means around a tree trunk and a plurality of spaced electrical connection means for male electrical plugs; electrical connection means for connecting said distribution strap means to a source of electrical power; and limb branch electrical circuit means for mounting on a tree limb and having male plug means on one end for connection with said distribution strap means and light means connected along said electrical circuit means including a socket for a light bulb.

2. An electrical lighting system for a tree in accordance with claim 1 wherein said electrical distribution strap means comprises a flexible strap of molded electrical insulating material, a pair of flexible electrical conductors embedded in said strap material along the length of said material transversely spaced one from the other, and a plurality of pairs of spaced apertures arranged longitudinally along said strap opening from one face of said strap intersecting said electrical conductors for electrically connecting prongs on a male electrical plug with said electrical conductors by insertion of said prongs into said apertures, an adjustable means along opposite end portions of said strap for connecting said strap end portions together to hold said distribution strap on a tree trunk.

3. An electrical lighting system in accordance with claim 2 wherein said connection means on said opposite ends of said electrical distribution strap comprises adhesive material adapted to stick together when said end portions are placed in contact one with the other.

4. An electrical lighting system for a tree in accordance with claim 3 wherein said electrical distribution strap means includes two electrical leads extending across said strap means in spaced relation, one of said leads being electrically connected with one of said longitudinal conductors along said strap means and the other of said leads being electrically connected with the other of said conductors in said strap means, a male plug having spaced prongs secured in one edge of said strap means with one of said prongs being electrically connected with one of said leads and the other of said prongs being connected with the other of said leads, said leads extending along second end portions from the opposite edge of said strap means, and a female electrical plug connected with second free ends of said leads extending from said strap means, said male plug prongs and said female plug being adapted for the connection of said strap means with a source of electrical power and for connection of said strap means with an adjacent like strap means along said tree trunk.

5. An electrical lighting system for a tree including a plurality of electrical distribution strap means and a plurality of limb branch circuit means in accordance with claim 4 for providing lighting along a plurality of limbs secured with and supported from said tree trunk.

6. An electrical lighting system for an artificial Christmas tree having a trunk and a plurality of limbs removably securable along said trunk and extending outwardly therefrom, said lighting system comprising: a plurality of electrical distribution straps securable around said trunk in spaced relation along the length of said trunk, each of said electrical distribution straps including a longitudinal strip of electrical insulating material having opposite end portions on opposite sides of said strap faced with an adhesive material whereby said straps are wrapped around said trunk with said opposite ends overlapping with said adhesive material in securing engagement for holding each of said straps on said trunk, each of said straps further including a pair of laterally spaced flexible electrical conductors extending substantially the length of said strap embedded therein in electrical insulating relationship from each other and from the outside surfaces of said strap, a plurality of spaced pairs of apertures extending into said strap from the outer surface thereof an edge of each of said apertures being aligned with an edge of one of said electrical conductors whereby electrical male plug prongs inserted into each pair of said apertures electrically contact said electrical conductors in said strap for conducting electric power from said conductors into said prongs of said male plug, said pairs of said apertures being longitudinally spaced along the lengths of said electrical conductors for insertion of a plurality of said male plugs around said distribution strap when said strap is on said tree trunk, a pair of spaced laterally extending electrical leads embedded in said strap each connected with a separate one of said electrical conductors in said strap and having free end portions extending from one edge of said strap, a female electrical plug connected with the free ends of said electrical leads for electrically connecting said leads with male plugs on an adjacent electrical distribution strap, and male plug prongs embedded in said strap extending from the opposite edge of said strap and electrically connected with separate ones of said electrical leads for electrically connecting said distribution strap with a female plug connected with an adjacent electrical distribution strap; a plurality of limb branch electrical circuits each comprising a pair of electrical leads having a male plug connected on a first end thereof for connecting said circuit with a pair of said apertures in one of said electrical distribution straps, the prongs on said male plug of said limb branch circuit being insertable into said apertures on said distribution strap, and electric light socket means secured along said limb branch circuit electrically connected with said leads for supplying electric power from said male plug on said branch circuit to a light bulb in said socket, said limb branch circuit being adapted to be secured on one of said removable limbs of said tree and said male plug on said circuit connected into an adjacent one of said electrical distribution straps on said tree trunk; and an electrical extension circuit including a pair of electrical leads having a female electrical plug on one end for connection with said male prongs on a bottom one of said distribution straps and a male plug on the other end for connection with a convenience outlet to supply electric power to said lighting system.

* * * * *